US006547503B1

(12) United States Patent
Böhm et al.

(10) Patent No.: US 6,547,503 B1
(45) Date of Patent: Apr. 15, 2003

(54) METHOD FOR PRODUCING A TWO CHAMBER PRESSURE PACK AND A DEVICE FOR CARRYING OUT THE SAME

(75) Inventors: Konrad Böhm, Volkertshausen (DE); Peter Wunsch, Horn (DE); Norbert Achten, Ohringen (DE)

(73) Assignee: Lechner GmbH, Rielasingen (DE)

( * ) Notice: Subject to any disclaimer, the term of this patent is extended or adjusted under 35 U.S.C. 154(b) by 0 days.

(21) Appl. No.: 09/529,599

(22) PCT Filed: Oct. 19, 1998

(86) PCT No.: PCT/DE98/03057

§ 371 (c)(1),
(2), (4) Date: May 30, 2000

(87) PCT Pub. No.: WO99/20543

PCT Pub. Date: Apr. 29, 1999

(30) Foreign Application Priority Data

Oct. 17, 1997 (DE) ..... 197 46 018

(51) Int. Cl.[7] ..... B21D 51/30

(52) U.S. Cl. ..... 413/4; 413/5; 72/379.4; 72/715

(58) Field of Search ..... 72/379.4, 715; 413/4, 5

(56) References Cited

U.S. PATENT DOCUMENTS 3,620,406 A * 11/1971 Evans et al. ..... 220/231
4,032,064 A * 6/1977 Giggard ..... 222/95
4,117,951 A * 10/1978 Winckler ..... 220/62.21
4,185,758 A * 1/1980 Giggard ..... 156/227
4,308,973 A * 1/1982 Irland ..... 220/495.01
4,667,384 A * 5/1987 Miller ..... 264/159
4,975,132 A * 12/1990 Thompson ..... 156/69
5,049,019 A * 9/1991 Franek et al. ..... 413/19
5,059,187 A * 10/1991 Sperry et al. ..... 128/200.23
5,061,140 A * 10/1991 Hamaguchi et al. ..... 156/69
5,123,571 A * 6/1992 Rebeyrolle et al. ..... 222/105
5,150,812 A * 9/1992 Adams ..... 215/12.2
5,217,139 A * 6/1993 Miczka, et al. ..... 220/495.01
5,388,716 A * 2/1995 Stoffel et al. ..... 222/3
5,704,513 A * 1/1998 Diamond et al. ..... 220/619
5,765,714 A * 6/1998 Nakano et al. ..... 220/619
5,779,424 A * 7/1998 Stoffel ..... 413/1
5,915,587 A * 6/1999 Kramer ..... 220/619
6,189,744 B1 * 2/2001 Prince ..... 156/305
6,220,311 B1 * 4/2001 Litto ..... 141/114
6,332,563 B2 * 12/2001 Baudin ..... 222/386.5

* cited by examiner

*Primary Examiner*—William Hong
(74) *Attorney, Agent, or Firm*—Max Fogiel

(57) ABSTRACT

A method for manufacturing a pressurized two-chambered container in the form of an aerosol can, in which a housing is provided with an opening that can be sealed tightly by a spray or aerosol valve. A product chamber and a propellant chamber are formed separately fluid-tight from each other by a flexible diaphragm in the housing. The product chamber can be charged with a product which can be release through said valve. The propellant chamber can be charged, on the other hand, with a compressed propellant. The product chamber communicates with the product-release opening. At least one end of a blank is left open to constitute subsequently the housing. The diaphragm is inserted into the blank through the open end, and the blank then is formed into the housing. An edge of the open end of the blank is reformed to narrow it into an integral mouthpiece that accommodates the product-release opening.

13 Claims, 2 Drawing Sheets

FIG. 3A
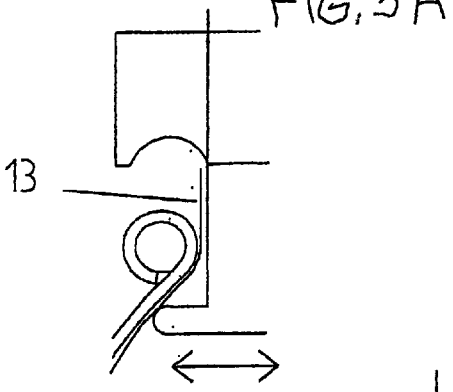
FIG. 3B
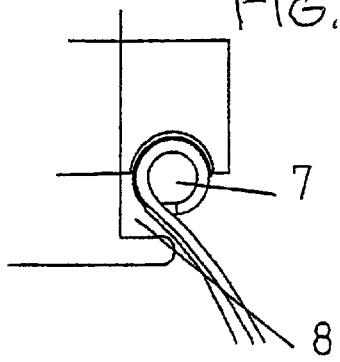
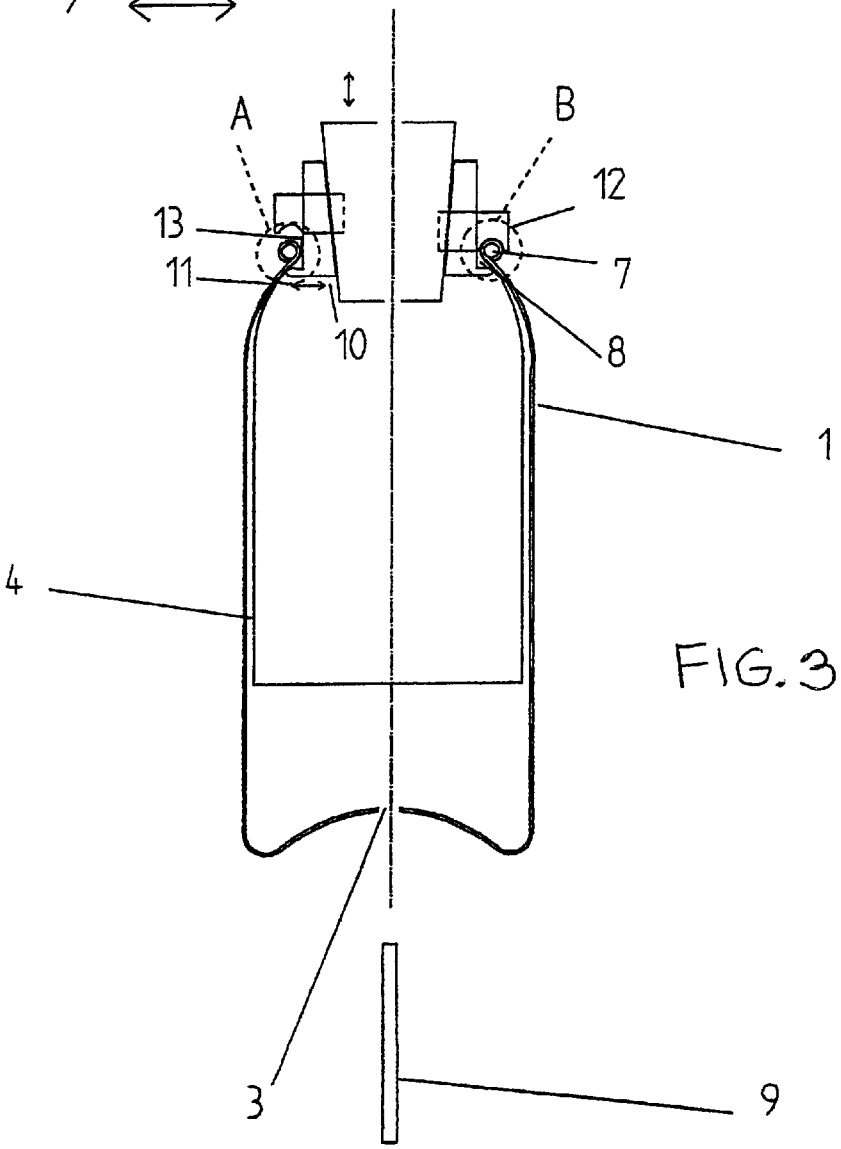
FIG. 3

METHOD FOR PRODUCING A TWO CHAMBER PRESSURE PACK AND A DEVICE FOR CARRYING OUT THE SAME

BACKGROUND OF THE INVENTION

The present invention concerns, first, a method of manufacturing a pressurized two-chambered container, especially a rotationally symmetrical aerosol can. The method comprises forming a housing with an opening that can be tightly sealed by a barrier, especially a spray-or-aerosol valve, and that the product can be released through, with a product chamber and a propellant chamber separated fluid-tight from each other by a flexible diaphragm in the housing, whereby the product chamber can be charged with product, the propellant chamber can be charged with a compressed propellant, and the product chamber communicates with the product-release opening. The present invention also concerns a device for carrying out the method.

Pressurized containers, aerosol cans for instance, are increasingly widely used for hair-care products, spray-on lacquers, automotive-maintenance sprays, furniture-care sprays, etc. The product is subjected to pressure by a propellant. When a product release, usually a valve, is actuated, the propellant forces the product out through it in the desired state, a jet. Pressurized containers comprising two chambers work similarly, with the product under pressure. Conventional aerosol cans comprise only one chamber, and can accidentally release propellant unmixed with product, which is why the can needs to be shaken before use. The propellant in a two-chambered pressurized container on the other hand is entirely separate from the product. There are considerable advantages. The product can be employed along with a propellant that is not compatible with it. The propellant is not released, which is highly desirable environmentally, and can even be recycled once the product has been used up.

Two-chambered pressurized containers wherein the propellant chamber is separated from the product chamber by a plastic piston or by inserting a flexible diaphragm in the form of a plastic pouch are known. There ia a considerable drawback to pistons, however. Even slight deformations or unevenness in the wall of the housing can impede or jam a piston and render the container useless. Furthermore, the inside cross-section of the housing must be precisely constant in form and dimension along the total stroke traveled by the piston, severely restricting the number of shapes that can be employed. Again, many aerosol cans have bulging tops, and some product is always left over inside, downstream of the piston's face. In versions that employ a plastic pouch of whatever shape, the pouch is inserted into the can through the product-release opening during manufacture and can be damaged. In mass production, this procedure must be carried out as rapidly as possible, often perforating or severely deforming the pouch to the extent that the container cannot be used. Known pressurized two-chambered containers can accordingly be manufactured only at a relatively high rate of rejects and are accordingly not entirely profitable.

SUMMARY OF THE INVENTION

One object of the present invention is a method of manufacturing pressurized two-chambered containers of any desired shape that can be carried out more economically than known methods. Another object is a device for carrying out the method.

The first object is attained in accordance with the present invention in an improved method of the aforesaid genus characterized in that the flexible diaphragm is inserted into a blank through at least one end that has been left open therein, subsequent to which the blank is finally shaped into a pressurized two-chambered container housing.

The flexible diaphragm, meaning the plastic pouch or similar structure in particular, is accordingly inserted into the housing that will demarcate the pressurized two-chambered container through a still entirely wide-open end before the housing is finally formed. Only then is the end finally formed, entirely closed, that is, or narrowed into a product outlet for example. The flexible diaphragm can be inserted into the blank at a high rate (higher than 100 per minute) through the still-open end, with no risk of damage or deformation and, once inside, shaped into any desired conformation without detriment to its function. Even bulging aerosol cans with product releases that are very small in relation to the volume of product in the product chamber can accordingly be manufactured particularly profitably and with a low percentage of rejects in the form of mass-produced pressurized two-chambered containers.

The device for carrying out the method in accordance with the present invention includes a mechanism for presenting the housing blank, in particular a rotationally symmetrical aluminum blank still entirely open at at least one end, a mechanism for inserting the flexible and fluid-tight diaphragm into the blank through the still entirely open end, a mechanism for forming the housing along with its product-release opening out of the blank, especially by reforming the edge of the open end to narrow it into a mouthpiece that accommodates the product release, and a mechanism for fastening and sealing the edge of the diaphragm to the housing while keeping the product chamber, which communicates with the product release, separate from the propellant chamber.

The subsidiary claims address advantageous embodiments of the present invention.

In one preferred embodiment of the method, the end of the housing that will constitute the mouthpiece with its product release in the finished housing is left open. In most aerosol cans, spray cans for instance, this will be the upper end. In the present embodiment, this section is reformed into a mouthpiece without adding anything extra, a cap for instance, which can be applied later. Preferably, this edge can be reformed by the application of such procedures appropriate for narrowing the housing at that section as bending, upsetting, or rolling for instance. The edge of the product release is preferably beaded to prevent injury and damage from sharp edges. The most preferable material for the housing blank is aluminum. The diaphragm can be plastic, especially thermoplastic, a plastic laminate, or composite sheet, preferably of or including a thermoplastic, that can resist other thermoplastics. In one particularly preferred embodiment of the present invention, the end (usually the base) of the blank pointing away from the site of the product release is provided, before the diaphragm is inserted, with a port that the diaphragm can be manipulated through inside the blank. The diaphragm can accordingly be shifted around inside the blank while the product release is being processed with no need to introduce a tool or other object through the open end. The pressurized two-chambered container can also be subsequently charged with propellant through this port. The diaphragm can preferably be an at least partly thermoplastic pouch. The pouch can easily be secured and sealed to the housing by heating and fusion, the propellant chamber being separated from the product chamber. It is of course conceivable in principle to secure at least one edge of the diaphragm to one wall of the blank before the latter has been formed. The simplest and most efficient approach to manufacturing such a pressurized two-chambered container when a pouch is employed as a diaphragm, however, is to fasten and seal the edge of the pouch to the edge of the product release. The pouch and the product chamber it occupies will accordingly be entirely enclosed in the propellant chamber. The pouch in one preferred embodiment is protected from any heat that might be released as the mouthpiece is being reformed by only subsequently raising the edge of the pouch beyond the edge of the product-release opening and fastening it thereto. The edge of the pouch can be lifted through the port facing the product release by subjecting the pouch to compressed air with a pneumatic tool or to the mechanical force of a tappet. In still another preferred embodiment, heated tool points fasten the pouch first to one inner edge of the housing by pressure applied to various points or areas for example. The projecting edge of the accordingly preliminarily secured pouch is then preferably wrapped around the edge of the product-release opening and fastened fluid-tight thereto by a hot wrapping-and-fastening tool, which expands and advances toward the edge. This approach is of particular advantage in that the edge of thermoplastic pouch will shrink as it cools and nestle tight against the edge of the product-release opening. This process will ensure additional sealing and tightness.

The device preferably includes, first, a mechanism for raising a diaphragm in the form of a pouch, especially of thermoplastic, by subjecting it to compressed air or to a tappet through a port in the end of the housing opposite the product release until the edge of the pouch projects beyond the edge of the product-release opening, second, a head preferably including segments equally distributed around it that heat up, spread out, and seize the edge of the pouch, securing it preliminarily to an inner edge of the housing, and third, a mechanism that heats up, preferably spreads out, and wraps the preliminarily secured projecting edge over the edge of the product-release opening, fastening it there permanently and tight by plasticizing it.

BRIEF DESCRIPTION OF THE DRAWINGS

One embodiment of the present invention will now be specified with reference to the accompanying drawing, wherein FIG. 3 is a longitudinal section through the body of the can at an intermediate stage of manufacture with the pouch secured to it.

FIGS. 3A and 3B are diagrammatic views showing the method for forming a rolled edge, according to the present invention.

DESCRIPTION OF THE PREFERRED EMBODIMENTS

Figure 1:
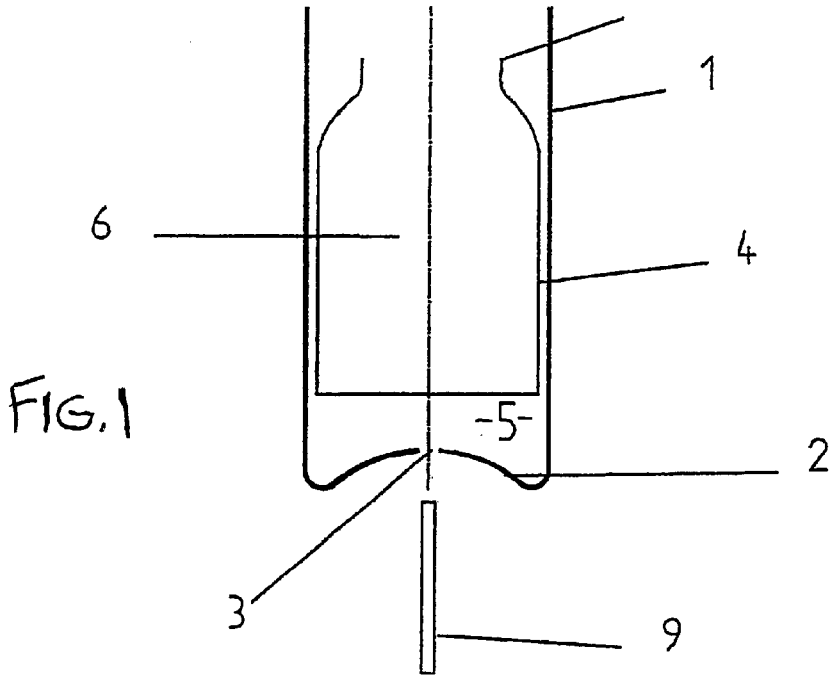
FIG. 1 is a longitudinal section through the body of an aerosol can at an initial stage of manufacture with a plastic pouch inserted therein.

In the manufacture of an aerosol can in the form of a pressurized two-chambered container, a blank that will eventually constitute the housing 1 represented in FIG. 1 is pressed out of a disk or sheet of aluminum. The blank essentially comprises a rotationally symmetrical cylindrical component, one end of which, the end that will eventually constitute the base 2 of the can, bulges inward in the form of a spherical surface. A port 3 has been bored or otherwise introduced through base 2. The other end of the blank, the end that will eventually constitute the top, has not yet been reformed and has been left entirely open. As illustrated in FIG. 1, a plastic pouch 4 (diaphragm) has been inserted into the blank through this end. The edge 13 of pouch 4 faces the open end. Pouch 4 can be manipulated through port 3 by compressed air or by a tappet 9 in the form of a round rod. A propellant chamber 5 has been left between pouch 4 and the wall of housing 1. Propellant will be injected into the chamber 5 in the finished pressurized two-chambered container, through port 3 for example, to allow expulsion of the actual product—enamel, hair lacquer, shaving foam lubricant, cleaning fluid, whipped cream, scent, etc., a seemingly endless variety, depending on the application—contained in the product chamber 6 that constitutes the inside of pouch 4.

Figure 2:
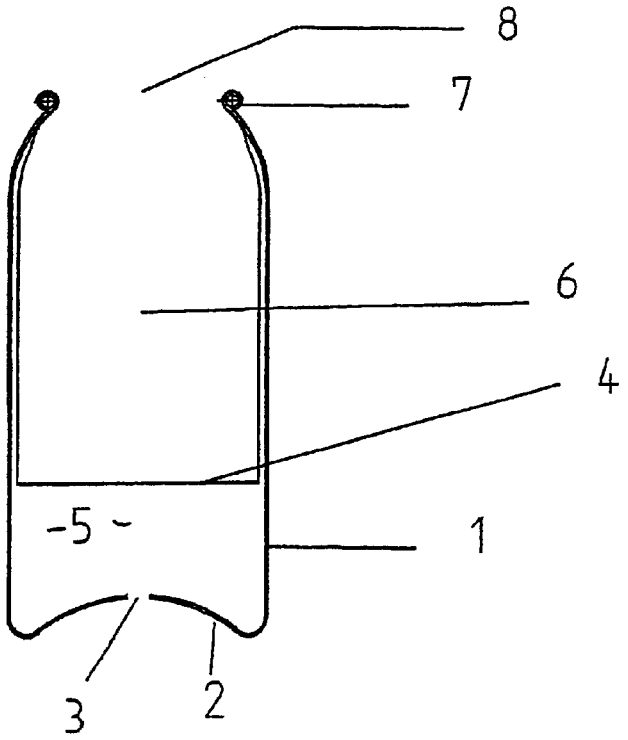
FIG. 2 is a longitudinal section through the can illustrated in FIG. 1 at the final stage of manufacture.

Once pouch 4 has been inserted, the open end of housing 1 is reformed to create the mouthpiece 8 depicted in FIG. 2. This procedure essentially involves flow pressing or drawing and especially upsetting and rolling the housing's edge. The edge is also provided with a bead 7. Bead 7 encloses the product release in the form of a valve that, until actuated, seals the product-release hole fluid tight.

To ensure total separation of propellant chamber 5 from product chamber 6, the edge of the pouch must be attached to housing 1 such as to establish a fluid-conveying communication with the product release.

The edge 13 of pouch 4 is accordingly attached tight to the edge of the product-release opening demarcated by the bead 7 as will now be specified with reference to FIG. 3. Tappet 9 or compressed air lifts product chamber 6 inside the housing toward mouthpiece 8 until the edge 13 of pouch 4 projects beyond bead 7 as represented in detail in FIG. 3A. A head with heated segments 10 distributed around it at angles of 120° is partly introduced into the product-release opening and spreads open in the direction indicated by the double arrow until segments 10 encompass an area of edge 13 and force it against a shoulder 11 on the inner surface of housing 1. Cleaning fluid, whipped cream, scent, or a similar product, depending on the a application, can be accommodated in the product chamber 6 inside pouch 4. Since edge 13 is at least partly thermoplastic, it will be plasticized by the heat emitted by segments 10 in those areas where it is forced against shoulder 11 and will accordingly fuse to the inner surface of housing 1. As segments 10 continue to spread, and/or as a hot edge wrapping-and-fastening tool 12, also part of the tool head illustrated in FIG. 3B, enters the opening, the section of edge 13 that projects beyond bead 7 will be wrapped around and pressed against the bead, accordingly softened and plasticized, and more or less hot-bonded to it. As the material cools, the outermost section of edge 13 will shrink tight against the bead. Edge 13 will accordingly be fastened firm and tight against the bead 7.

The pressurized two-chambered container is illustrated at this stage, without a valve and with its port still open, in FIG. 2. It will now be delivered to the product manufacturer or packager, who will charge product chamber 6 through the product-release opening. This opening will then be tightly closed by for instance beading the metal edge of a product-release valve to bead 7, the section of edge 13 bonded thereto at that point acting as a seal. Before, during, or after the charging of product chamber 6, propellant chamber 5 will be charged with a liquified or inert gas or just with compressed air through port 3, which will then be closed.

Although only pressurized two-chambered containers have been hereintofore addressed, it will be obvious that several product chambers and propellant chambers can be employed in principle, depending on the purpose. The propellant chamber and/or the product chamber can for example be further separated by additional diaphragms when the product comprises two fluids that are to be combined only just before being released. Although it seems more convenient to fasten edge 13 to bead 7 because of the tight fit ensured by the shrinkage and because of the improved manipulation, it is in principle possible to fasten the edge tight to a site axially closer to base 2 on the inner surface of housing 1. This approach could even be carried out through the still open end before the formation of mouthpiece 8.

The method hereintofore described will turn out more than 100 aerosol cans a minute. It should preferably be carried out entirely automatically. A device for carrying out the entirely automatic method in particular has not been explicitly specified herein, but will include a mechanism for presenting the housing blanks for forming, a mechanism for inserting the plastic pouches into the blanks, a mechanism for reforming the mouthpieces into the blanks that accommodate the pouches, and tools for pressing, specifically upsetting, rolling, or beading the edges of the blanks. The device for manufacturing pressurized two-chambered containers will also be provided with a mechanism for manipulating and lifting the pouches by means of a cylindrical rod and a mechanism for attaching the edge of the pouch to the bead and featuring an effectively heated segmented head and an edge wrapping-and-fastening tool.

We claim:

1. A method of manufacturing a pressurized two-chambered container and in particular a rotationally symmetrical aerosol can, comprising the steps of:

forming a housing with an opening sealable tightly by a barrier in form of a spray-or-aerosol valve;

forming a product chamber and a propellant chamber separated fluid-tight from each other by a flexible diaphragm or pouch in said housing;

charging said product chamber with a product, said product in said can being releasable through said valve, said propellant chamber being chargeable with a compressed propellant;

communicating said product chamber with the product-release opening;

leaving open at least one end of a blank to constitute subsequently said housing with said propellant chamber and said product chamber;

inserting said diaphragm into said blank through the open end; and forming thereafter said blank into said housing;

reforming an edge of said open end of said blank to narrow it into an integral mouthpiece accommodating said product-release opening, when forming said blank into said housing; said mouthpiece being integral with said housing, said mouthpiece being formed from a cylindrical form to a conical form after insertion of said diaphragm, said diaphragm being applied at said edge;

wherein said end of said blank is opposite the end left open and is formed into a base with a bore to manipulate said diaphragm therethrough, and wherein including a step of lifting said pouch by manipulating said pouch with compressed air or a tappet extending through said bore.

2. A method as defined in claim 1, wherein said mouthpiece is reformed by pressing and by bending, upsetting, or rolling said edge.

3. A method as defined in claim 1, wherein said edge comprises a bead.

4. A method as defined in claim 1, wherein said blank is of aluminum.

5. A method as defined in claim 1, wherein said product chamber is separated from said propellant chamber by securing an edge of said diaphragm tight to said housing.

6. A method as defined in claim 1, wherein said diaphragm is a thermoplastic pouch.

7. A method as defined in claim 6, including the step of securing an edge of said thermoplastic pouch to said housing by fusion after said housing has been formed.

8. A method as defined in claim 7, including the step of lifting said pouch to allow said edge of said pouch to be fastened or wrapped.

9. A method as defined in claim 7, wherein said edge of said pouch is secured and attached by a head; distributing first heated segments around said head at an equal angle, said segments grasping said edge of said pouch and preliminarily securing said edge of said pouch to part of an inner surface of said housing, and second once the pouch has been preliminarily secured, wrapping said edge of said pouch over the edge of the product-release opening plasticizing and attaching said edge of said pouch tightly to said edge of said product-release opening by an expanding heated tool.

10. A method as defined in claim 6, including the step of fastening an edge of said pouch to said first-mentioned edge of the product-release opening by wrapping said edge of said pouch over said first-mentioned edge.

11. A device for manufacturing a pressurized two-chambered container in form of a rotationally symmetrical aerosol can, comprising a blank for a rotationally symmetrical aluminum aerosol can, said blank being entirely open at at least one end; means for inserting a flexible and fluid-tight diaphragm into said blank through said entirely open end; means for forming a housing having an opening for releasing product therefrom and for reforming an edge of said open end by narrowing it into a mouthpiece enclosing said opening; means for fastening an edge of said diaphragm tightly to said housing while keeping a chamber therein charged with a product and communicating with the product release opening and separate from a chamber therein charged with propellant;

and means for manipulating a thermoplastic pouch comprising said diaphragm raised by compressed air or tappet through an opening in the end of said housing remote from said product release opening until said edge of said pouch projects beyond the end of the product release opening, where it can be fastened by tool means.

12. A device as defined in claim 11, wherein said tool means securing and attaching said edge of the pouch comprises heated segments distributed around said pouch edge at equal angles for grasping the pouch edge and preliminarily the pouch edge to part of an inner surface of said housing; said tool means comprising an expanding heated tool wrapping the projecting edge of the pouch over the edge of the product-release opening, plasticizing said pouch edge and attaching said pouch edge tightly to the edge of the product-release opening after the pouch has been preliminarily secured.

13. A method of manufacturing a pressurized two-chambered container and in particular a rotationally symmetrical aerosol can, comprising the steps of:

forming a housing with an opening sealable tightly by a barrier in form of a spray-or-aerosol valve;

forming a product chamber and a propellant chamber separated fluid-tight from each other by a flexible diaphragm in said housing;

charging said product chamber with a product, said product in said can being releasable through said valve, said propellant chamber being chargeable with a compressed propellant;

communicating said product chamber with the product-release opening;

leaving open at least one end of a blank to constitute subsequently said housing with said propellant chamber and said product chamber;

inserting said diaphragm into said blank through the open end; and forming thereafter said blank into said housing;

reforming an edge of said open end of said blank to narrow it into an integral mouthpiece accommodating said product-release opening, when forming said blank into said housing;

said mouthpiece being integral with said housing, said mouthpiece being formed from a cylindrical form to a conical form after insertion of said diaphragm, said diaphragm being applied at said edge, said mouthpiece being reformed by pressing and by bending, upsetting or rolling said edge, said edge comprising a bead, said blank being of aluminum, said end of said blank being opposite the end left open and being formed into a base with a bore to manipulate said diaphragm therethrough, said product chamber being separated from said propellant chamber by securing an edge of said diaphragm tight to said housing, said diaphragm being a thermoplastic pouch;

securing an edge of said thermoplastic pouch to said housing by fusion after said housing has been formed;

fastening an edge of said pouch to said first-mentioned edge of the product-release opening wrapping said edge of said pouch over said first-mentioned edge;

lifting said pouch to allow said edge of said pouch to be fastened or wrapped;

lifting said pouch by manipulating said pouch with compressed air or a tappet extending through said bore, said edge of said pouch being secured and attached by a head;

distributing first heated segments around said head at an equal angle, said segments grasping said edge of said pouch and preliminarily securing said edge of said pouch to part of an inner surface of said housing and second, once the pouch has been preliminarily secured, wrapping said edge of said pouch over the edge of the product-release opening, plasticizing and attaching said edge of said pouch tightly to said edge of said product-release opening by an expanding heated tool.

* * * * *